United States Patent [19]

Sedlmair et al.

[11] Patent Number: 4,685,696

[45] Date of Patent: Aug. 11, 1987

[54] FRONT PIECE FOR A SAFETY SKI-BINDING

[75] Inventors: Gerhard Sedlmair, Farchant; Walter Knabel, Murnau; Werner Messerschmidt, Garmisch-Partenkirchen, all of Fed. Rep. of Germany

[73] Assignee: Marker International, Salt Lake City, Utah

[21] Appl. No.: 762,915

[22] Filed: Aug. 5, 1985

[30] Foreign Application Priority Data

May 12, 1983 [DE] Fed. Rep. of Germany ..... 3343943
Dec. 4, 1984 [WO] PCT Int'l Appl. ... PCT/EP83/00386

[51] Int. Cl.[4] ..... A63C 9/085
[52] U.S. Cl. ..... 280/625; 280/629
[58] Field of Search ..... 280/625, 629, 634

[56] References Cited

U.S. PATENT DOCUMENTS 3,744,810 7/1973 Jungkind ..... 280/625
4,067,594 1/1978 Kikuchi ..... 280/625

FOREIGN PATENT DOCUMENTS 1966462 4/1973 Fed. Rep. of Germany ..... 280/625
2255604 5/1974 Fed. Rep. of Germany ..... 280/625
491653 7/1970 Switzerland ..... 280/625

*Primary Examiner*—David M. Mitchell
*Attorney, Agent, or Firm*—D. Peter Hochberg

[57] ABSTRACT

The invention relates to a front piece for safety ski-bindings. The front piece comprises a supporting member which can be pivoted sideways. Linked to the support member are side clamps for engaging the toe of a ski boot in order to hold the ski boot in the front piece of the safety ski-binding. The side clamps are releasable when a predetermined force is applied to the side of the ski binding. The binding of the present invention will automatically reset after the side clamp is released and the boot is free from the binding. An advantage of the mechanism of the present invention is that internal friction is minimized during the release/reset operation. This is achieved in part by the side clamps being designed such that they are extended beyond their respective points where they are pivotally attached to the supporting member.

8 Claims, 8 Drawing Figures

FRONT PIECE FOR A SAFETY SKI-BINDING

The present invention relates to a front piece for a safety ski-binding.

Such front pieces are known from a number of references, for instance German "Auslegeschrift" Nos. 18 09 889 and 19 10 808. Front pieces based on said publications have not yet been introduced into the market. Front pieces of this have an advantage over front pieces which are presently on the market in that the side clamps of said front pieces follow a pivotable movement of the ski boot in the resilient (elastic) area of the front piece so that no friction occurs between the side clamps and the ski boot sole in this resilient area. Further, because of the foregoing effect, only a small sensitivity exists with respect to the pressure caused by the heel holding apparatus, and moreover a relatively good reset characteristic is obtained.

The known front pieces of this general type allow in the resilient area a relative movement between the side clamps and the link quadrangle, a relative movement which also causes frictional forces which have the known disadvantages.

It is an object of the present invention to overcome the disadvantages of the front pieces of the prior art. It is a specific object of the present invention to provide a front piece for a ski binding in the above mentioned frictional forces are avoided and that consequently the reset characteristic of the front piece is improved.

In accordance with the preferred form of the present invention, during the pivotable movement of the supporting member—when the ski boot is inserted—no relative movement occurs between the supporting member and the side clamps.

In accordance with a preferred embodiment of the invention, the design of the front piece may be simplified with respect to known front pieces by providing that the mounting pins for mounting the supporting member on the levers of the link quadrangle are also used for supporting the side clamps.

Another desirable modification provides that the locking member is a lever which is mounted on the supporting element axially parallel with respect to the side clamps. Further, for this locking member, at least one control member is provided which is independent of the link quadrangle. This design results in an extremely low inner resistance.

In accordance with a practical design in accordance with the inventive concept outlined above, a first embodiment of the invention provides that the above-mentioned lever is an elongated lever having two arms, and for this lever abutment means are provided which serves as a control member on both sides of the plane of symmetry of the front piece; the abutment means being fixedly mounted on a plate of said ski-binding.

In accordance with another embodiment of the invention, it is provided that the lever is a two-arm lever, with the second arm being two-pronged forming two divergent curved branch portions adapted to cooperate with a central control member, with the consequence that no special reset springs for the blocking member are required. Preferably, the control member comprises a spring-loaded bolt of the detent means.

In accordance with a preferred embodiment of the invention the extensions of the side clamps may be articulatedly connected with each other by means of at least two connecting levers. In the case where two connecting levers are used, each connecting lever forms the second arm of a bent lever; the connecting pin of the two connecting levers forming a movable link of the two bent levers which is normally fixedly located by the blocking member.

Another embodiment comprises three connecting levers. One connecting lever is arranged in the middle forms a blocking member and comprises two similar arms in a mirror-like arrangement. Each one of these latter forms one arm of two bent levers with the other arms of the bent levers being formed by the outer connecting levers; the connecting pins of the connecting levers serve, together with the extensions of the side clamps, as movable links of the bent levers.

So as to reduce the friction within the front piece when using a detent means having a detent indentation which is movable against a spring force, another embodiment of the invention provides that the detent indentation comprises two mirror-like levers which cross each other, these levers being pivotally mounted on axes which are fixedly mounted on the base plate, and the spring force is transmitted to the levers at the location of the crossing point. This concept may also be used in connection with any front piece as long as the front piece has similar detent means.

Embodiments of the front piece in accordance with the invention are described in connection with the drawing wherein.

Figure 1:
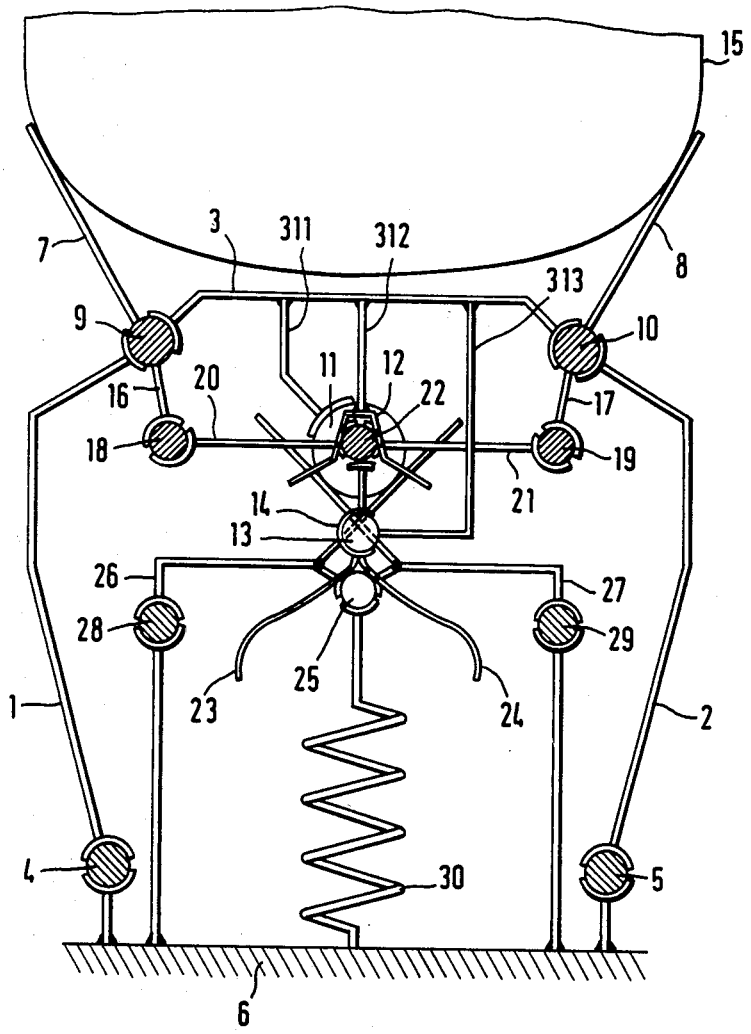
FIGS. 1–3 show in a schematic representation a front piece in its normal position, an intermediate position and a release position, respectively.

The front piece shown in FIGS. 1–6 comprises a link quadrangle which comprises levers 1 and 2 as well as a coupling element 3. Each of said levers 1, 2 is pivotally mounted on an axle 4 and 5, respectively. Axles 4 and 5 extend perpendicularly to a plane defined by the ski. Said axles 4, 5 are in turn mounted in a housing 6 of the front piece. The coupling element 3 serves as a supporting member for two side clamps 7, 8; each of side clamps 7, 8 is pivotally mounted on a mounting pin 9 and 10, respectively, of said coupling element. Also levers 1 and 2 are pivotally mounted on mounting pins 9 and 10, respectively. The coupling element 3 supports in different horizontal planes a detent roller 11 as well as a detent indentation 12 for a detent member yet to be described; detent roller 11 is pivotally supported parallel to said axles 4 and 5. Said coupling element supports further in a pivotal manner a pin 13 which also extends parallel to said axles 4 and 5 and is adapted to pivotally support a locking lever 14. In the schematic representations of the FIGS. 1–3, the connections of the appropriate parts 11, 12, 13 with the coupling element 3 are designated by reference numerals 311, 312 and 313.

The side clamps 7, 8 which support the ski boot sole from the sides and from the front extend beyond their respective mounting pins 9 and 10. At the free ends of the thus formed arms 16, 17, connecting levers 20 and 21, respectively, are pivotally mounted by means of a pin 18 and 19, respectively. Both connecting levers 20, 21 are connected with each other by means of a link pin 22 which extends parallel to axles 4 and 5. Link pin 22 serves at the same time as the detent member and is intended for cooperation with detent indentation 12. During the normal operational condition of the front piece, the link pin 22 is secured in its position in the detent indentation 12 by means of the locking lever 14.

The locking lever 14 is designed in the form of a two-prong lever in such a manner that its arm, which does not form the locking arm, comprises two prong portions, with each of prong portions 23 and 24, respectively, forming a cam or control curve. Said cam or control curve is adapted for cooperation with a central control member 25 which is described in detail below.

In the normal state of operation of the front piece, the detent roller 11 on the coupling element 3 of the link quadrangle is in engagement with a detent indentation which comprises the two mirror-like crossing levers 26 and 27. Each of levers 26, 27 is pivotally mounted on an axle 28 and 29, respectively. Axles 28, 29 are provided within housing 6 and extend parallel to axles 4 and 5. Both levers 26, 27 are under the influence of a spiral pressure spring 30. Spiral pressure spring 30 is supported by the housing 6 and transmits its force via the control member 25 to levers 26, 27. Levers 26, 27 are arranged below the locking lever 14, and they are offset with respect to each other in vertical direction (see FIG. 4).

Figure 2:
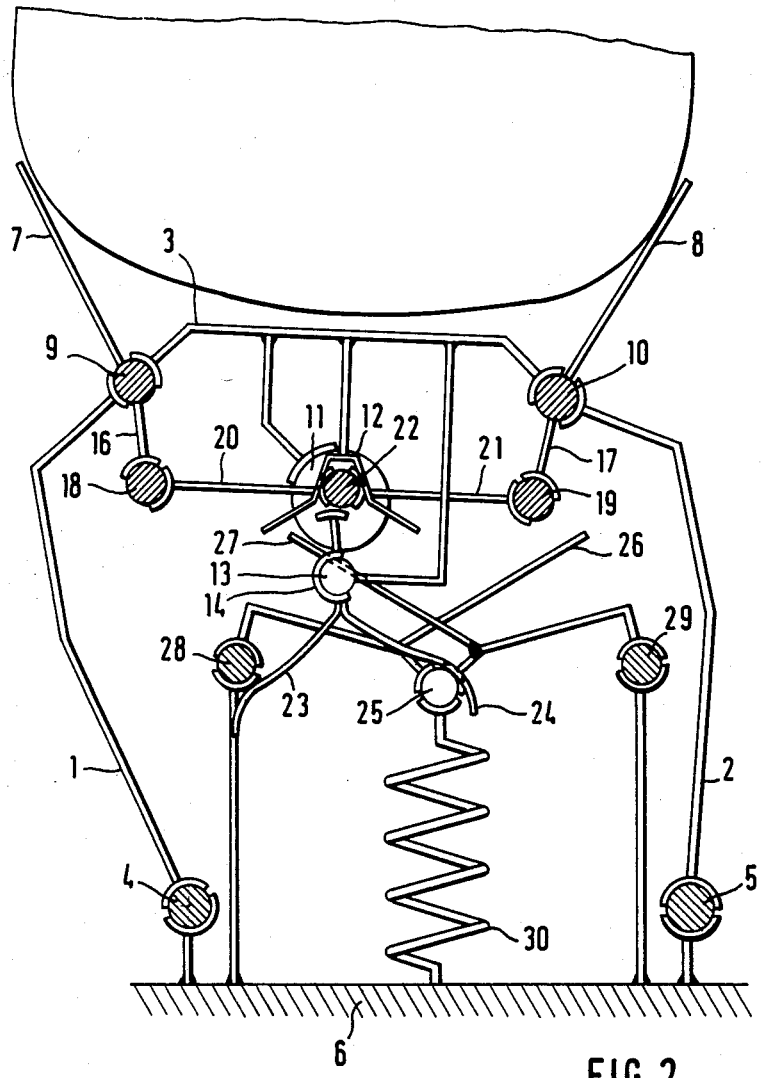

Under normal conditions, the individual components of the front piece have the positions shown in FIG. 1. Assuming that, for instance, a force is transmitted by the ski boot sole 15 onto the side clamp 7 by an amount which exceeds the bias of the spiral pressure spring 30, then a pivotal movement of the link quadrangle is the consequence, as is shown in FIG. 2. While this pivotal movement occured, the side clamps 7, 8 did not move with respect to coupling element 3. However, the detent roller 11 did run up lever 27 and did pivot lever 27 against the force of the spiral pressure spring 30 in a counterclockwise sense so that the components of the front piece are reset into the starting position shown in FIG. 1 under the influence of the coil pressure spring if said force decreases.

FIG. 2 shows further that, during the pivotal movement, the locking lever 14 is pivoted about pin 13 of coupling element 3 inasmuch as the lagging prong portion 24 of the locking lever 14 runs up the central control member 25.

Figure 3:
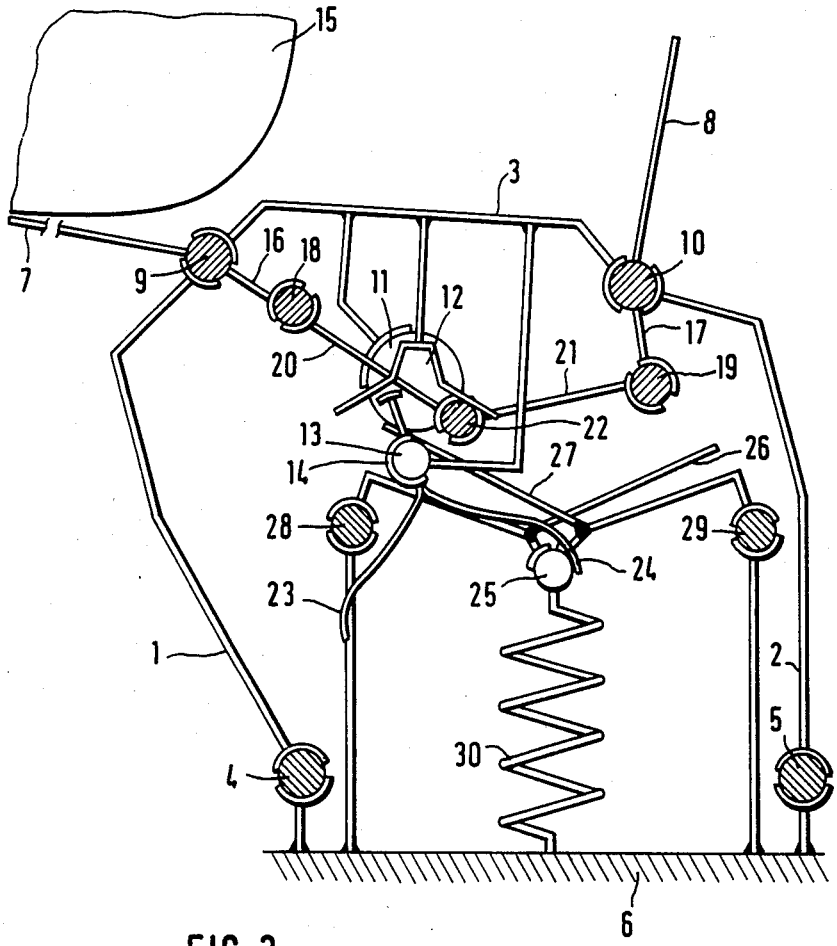

In case that a sufficiently high force is applied, the coupling element 3 will be moved sideways to such an extent that the locking lever 14 releases the link pin 22, with the consequence that link pin 22 moves out of the detent indentation 12 on the side which is considered to be the backside with respect to the direction of movement. This effect is caused by the side clamp which is arranged at the front with respect to the direction of movement, said side clamp now being able to pivot outwardly with respect to the coupling element 3 such that the ski boot sole 15 is released. This position is shown in FIG. 3. After the ski boot sole is released from the front piece, the components of the front piece return to the normal positon shown in FIG. 1.

Figure 4:
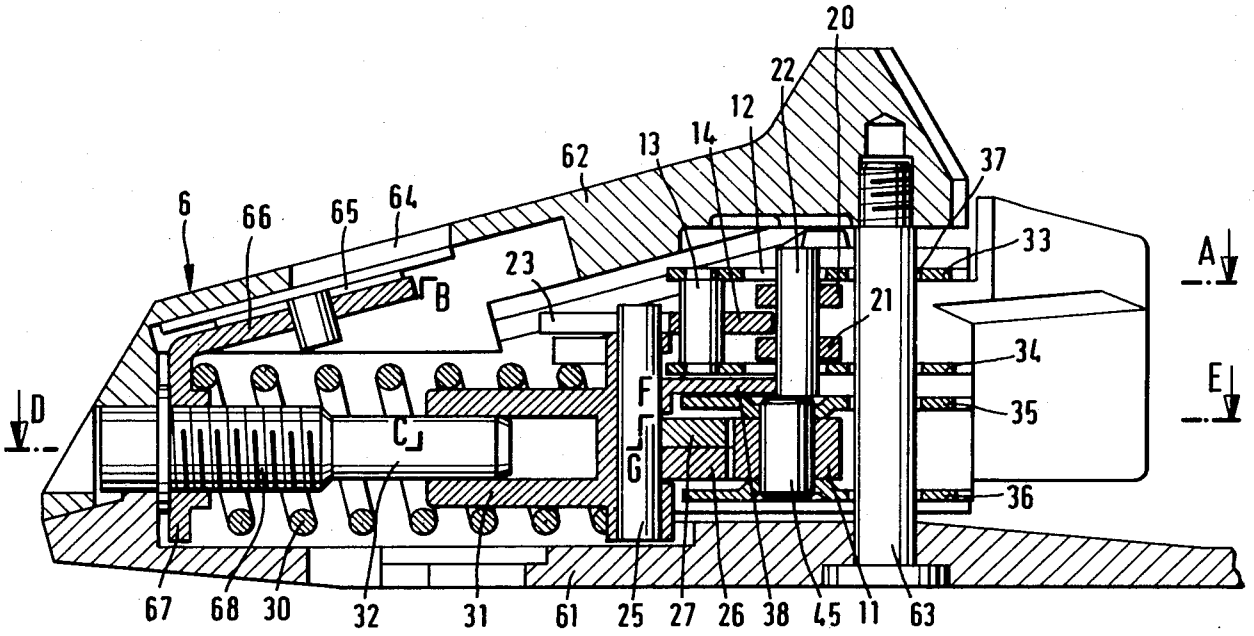
FIG. 4 is a longitudinal sectional view taken approximately in the middle of the construction shown in FIGS. 1–3.

FIG. 4 shows that the housing 6 comprises a base member 61 and a cover 62 which is mounted on said base member 61 by means of screws. The base member 61 is adapted to be mounted on the ski in a manner known per se. A connecting screw 63 is shown in FIG. 4. In the cover 62, a window 64 is provided in a manner known per se. Below said window, a pointer 65 is provided to display the pre-set release force. This pointer 65 is connected to a tab 66 of a spring support 67. The spiral pressure spring is supported at the housing 6 via an adjustment or set screw 68 and via said spring support 67. A molded member 31 supports the central control member 25 which is in the form of a pin. The molded member 31 acts upon the spiral pressure spring 30. The molded member 31 is in turn guided for longitudinal movement on the reduced diameter end 32 of said adjustment screw 68. Said end 32 is free of thread means.

Figure 5:
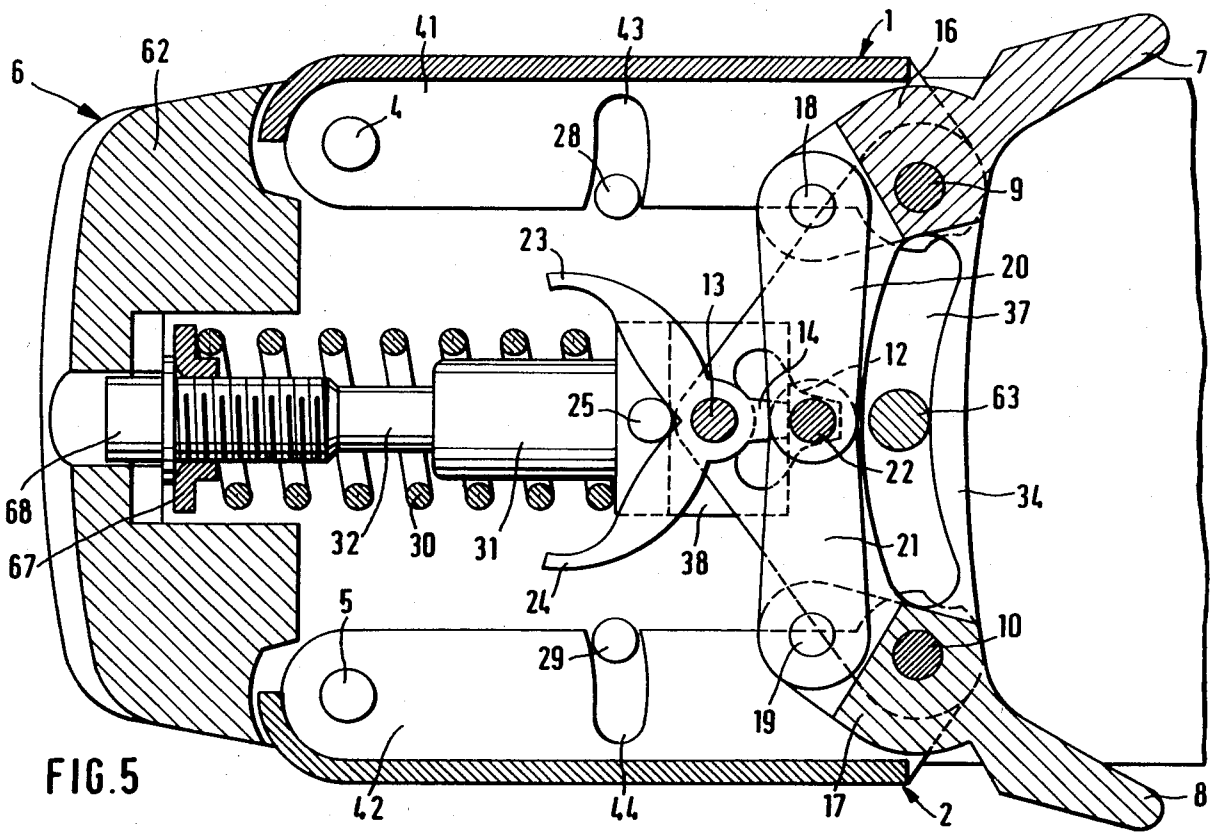
FIG. 5 is a cross-sectional view along line A-B-C-D in FIG. 4.
Figure 6:
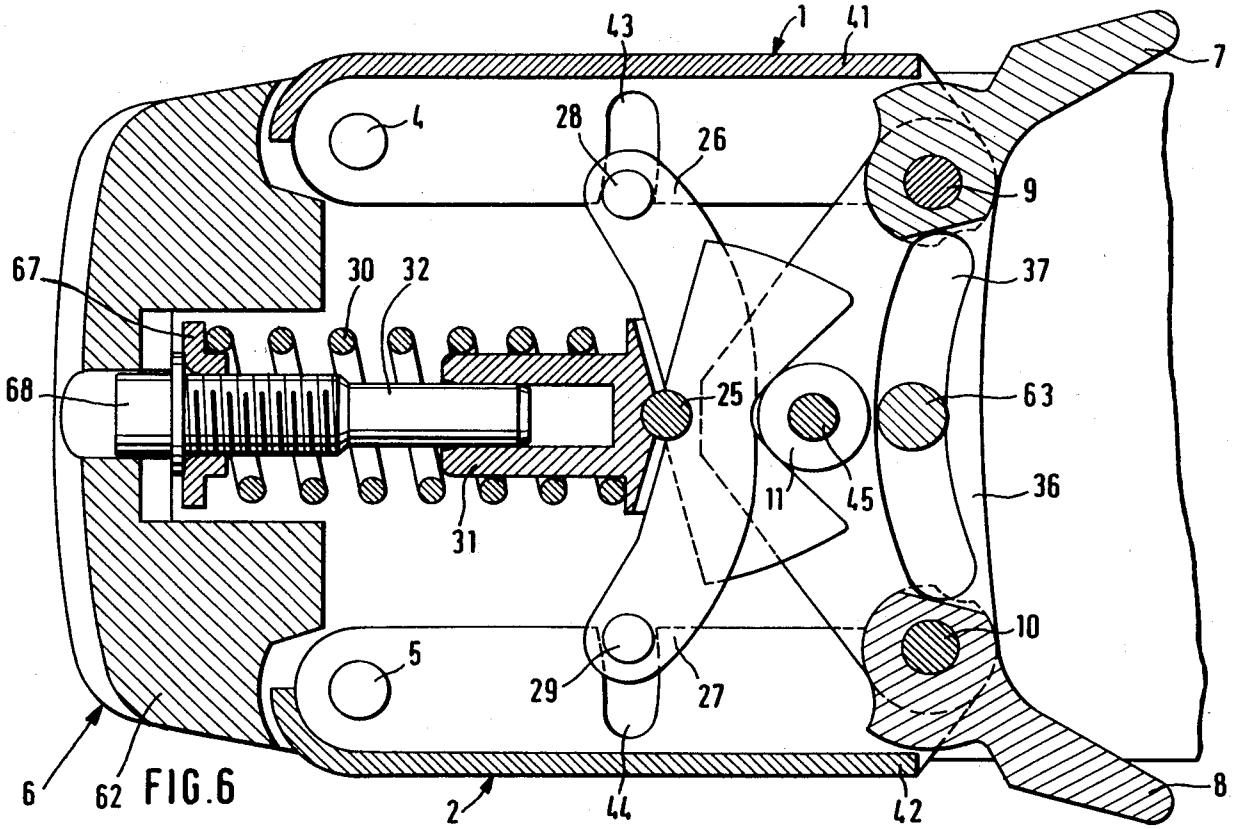
FIG. 6 is a cross-sectional view along line E-F-G-D in FIG. 4.

The coupling element 3 of the link quadrangle comprises four stamped sheet metal pieces 33, 34, 35, 36 which are shown in FIG. 4 in a cross-sectional view. The two upper pieces 33, 34 are congruent to each other and also the two lower pieces 35, 36 are congruent. In FIG. 5 the plan view of the stamped sheet metal pieces 33, 34 is shown. In FIG. 6 a similar view of the stamped sheet metal pieces 35, 36 is shown. In stamped sheet metal pieces 33, 34, pin 13 is pivotally mounted. Pin 13 carries locking lever 14. Between stamped sheet metal pieces 33, 34, the connecting levers 20, 21 are located and vertically offset with respect to each other. For link pin 22, which connects levers 20, 21 an opening is provided in stamped sheet metal pieces 33, 34, an opening which forms the detent indentation 12 for the link pin 22. Each one curved elongated opening 37 is provided which allows the passing of the connecting screw. The molded member 31 further comprises a tongue 38 which extends beyond the pin 25 to the link pin 22. Tongue 38 serves for the reset operation of the link pin 22 after one of the side clamps has been released.

Levers 1 and 2 of the link quadrangle are formed by substantially U-shaped bent stamped sheet metal pieces 41 and 42, respectively; pieces 41 and 42 are shown in FIGS. 5 and 6 in a section across the web. Each leg comprises a cut-out portion 43 and 44, respectively. An axle 28 and 29, respectively, is adapted to extend through cut-out portions 43 and 44, respectively, and each of said axles 28 and 29 is fixedly mounted on the housing.

In stamped sheet metal pieces 35, 36, an axis pin 45, which supports the detent roller 11, is pivotally mounted. As was already explained in connection with the schematic FIGS. 1, 2 and 3, the two mirror-like levers 26, 27, which cross each other, form the detent indentation (FIG. 6) for the detent roller. The levers which are pivotally mounted on the axles 28, 29 are under the influence of the spiral pressure spring 30 which acts via the central control member 25 and the molded member 31. In each of said stamped sheet metal pieces 35, 36 a curved elongated opening 37 is provided in a manner similar to stamped sheet metal pieces 33, 34; the elongated opening 37 allows the passage of the connecting screw 63.

Figure 7:
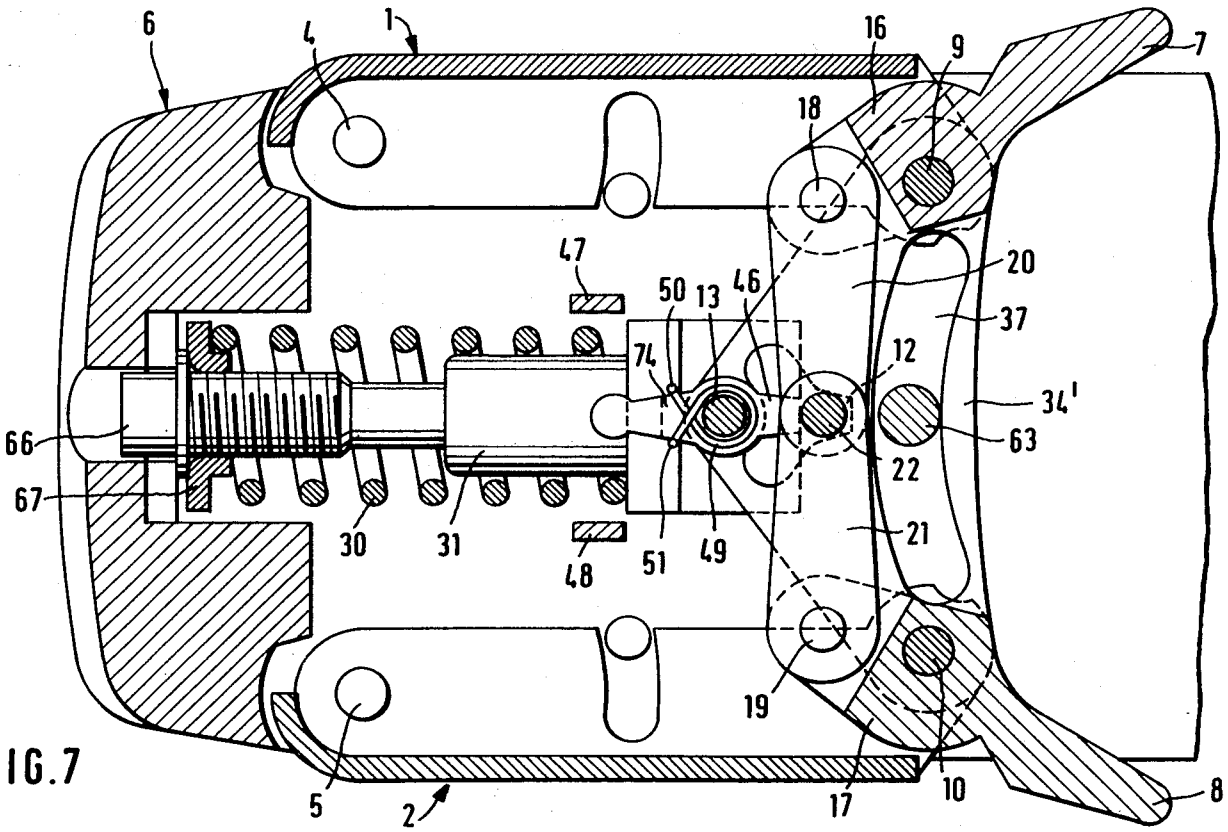
FIG. 7 is a modification of the front piece shown in a horizontal crooss-sectional view corresponding to FIG. 5.

The front piece shown in FIG. 7 differs from the front piece described so far only to some extent. Therefore, for the same parts the same reference numerals are used. Also, a repetition of the description of the front piece of FIG. 7 is not deemed to be necessary. The front piece of FIG. 7 uses instead of locking lever 14 a locking lever 46. The locking lever 46 also comprises two arms. The locking lever 46 is not under the influence of a central control member, a member which is formed by pin 25 in the embodiment described before.

In the embodiment of FIG. 7, the central control member is replaced by two abutment means 47, 48. Abutment means 47, 48 are arranged symmetrically with respect to the longitudinal middle plane of the front piece. The abutment means 47, 48 are fixedly mounted on the housing. A centering spring 49 holds the locking lever 46 in its normal position, as is shown in FIG. 7. The spring is a wound bending spring which is arranged on pin 13. Pin 13 in turn forms the pivotal axis for the locking lever 46. The legs 50, 51 of the spring 49 are arranged above the locking lever 46. The free ends of spring 49 are angularly bent downwardly and abut in the normal position not only at the locking lever 46 but also at the stamped sheet metal piece 34'. Stamped sheet metal piece 34' forms a portion of coupling element 3 and comprises a nose member 74 which is in abutment with the sides of the locking lever 46 which is arranged thereabove.

In the event that a force is transmitted onto one of said side clamps which exceeds the bias of the spiral pressure spring 30, then a pivotal movement of the link quadrangle occurs similar to what was described in connection with FIGS. 1–7. During said pivotal movement, no movement of the side clamps 7, 8 with respect to the coupling element 3 taken place as long as the release position is not yet reached. Immediately prior to reaching said release position, the arm of the locking lever 46—an arm which does not form the locking arm for the link pin 22—abuts against the corresponding abutment means 47 and 48, respectively. Due to said abutment, the locking lever 46 is pivoted about pin 13 against the force of the centering spring 49 during the last phase of the pivotal movement of said link quadrangle. As a consequence, the link pin 22 is released. The continued release of the front piece and the release of the ski boot occurs in the same manner as was described in connection with FIGS. 1–6. At the moment the link quadrangle is reset also the locking lever 46 returns to its starting position due to the action of the centering spring 49. This is so because the appropriate leg of said centering spring 49 was taken along during the pivotal movement of the locking lever 46 after the link pin 22 had again assumed its position in the detent indentation 12.

Figure 8:
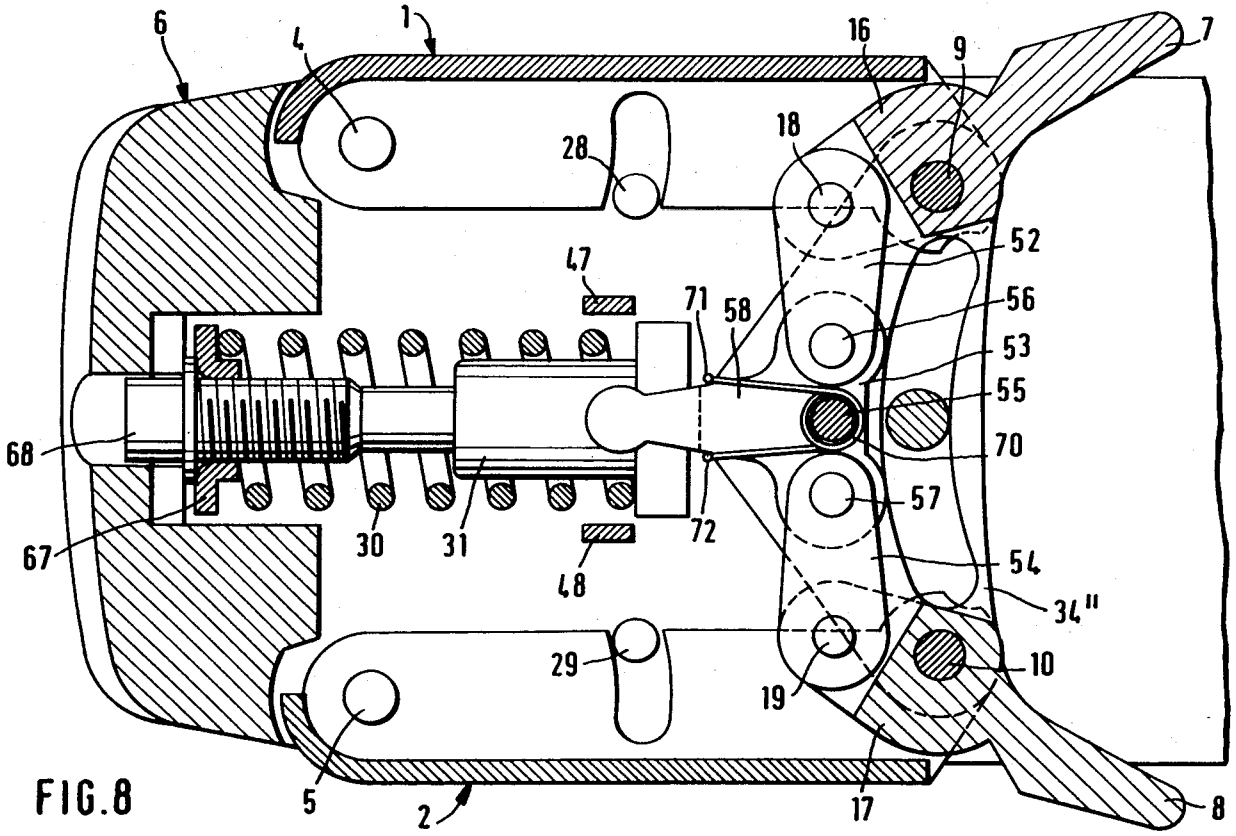
FIG. 8 is another modification of a front piece shown in a sectional view which corresponds to the sectional view of FIG. 7.

In the embodiment described so far, connecting levers 20, 21 were provided between the arms 16 and 17 of the side clamps 7 and 8; said connecting levers 20, 21 being connected with each other by means of a link pin 22. In contrast thereto, the embodiment of a front piece as shown in FIG. 8 comprises three connecting levers 52, 53, 54. The connecting lever 53 arranged in a middle position extends parallel to the axes of said side clamps. The connecting lever 53 is pivotally mounted on a link pin 55, which is in turn mounted on said coupling element. The coupling element of this embodiment does not have a detent indentation anymore. The connecting lever 53 is T-shaped. Each of its legs is connected by means of each link pin 56 and 57, respectively, with one of the outer connecting levers 52 and 54, respectively. As may be gathered from FIG. 8, the pins 18, 56, 55, 57 and 19 are arranged in a vertical cross plane of the front piece.

Similar to the embodiment of FIG. 7, the connecting lever 53 extends with its web 58 between two abutment means 47 and 48, abutments which are fixedly mounted on the housing. The connecting lever 53 is kept under the influence of a centering spring 70, a spring which keeps connecting lever 53 in the normal position as shown in the drawing. As was disclosed in connection with the embodiment of FIG. 7, the spring 70 of the embodiment shown in FIG. 8 is a wound bending spring which sits on the link pin 55 of the connecting lever 53. Again, the free ends of the legs 71, 72 of spring 70 are angularly bent downwardly and abut not only at web 58 of the connecting lever 53 but also at a stamped sheet metal piece which is designated in this embodiment by reference numeral 34''. Said stamped sheet metal piece 34'' forms—as was true for the embodiments described above—a part of the coupling element of the link quadrangle.

In a manner which corresponds to the operation of the front piece of the embodiment of FIG. 7, also for the embodiment of FIG. 8 the initiation of the release occurs by abutment of the web 58 of the connecting lever 53 at a corresponding abutment means 47 and 48, respectively, arranged in the housing. During the subsequent small continued pivotal movement of the link quadrangle, link pin 56 and 57, respectively, is moved by the tip of the boot out of the common cross plane of said pins. This is caused by the fact that during said continued pivotal movement of the link quadrangle, the web 58 is held back. It should be noted that the link pin 56 and 57, respectively, which is located in the direction of movement towards the front is the one which is moved out of said cross plane. The consequence of all this is that the locking means for the corresponding side clamps 7 and 8, respectively, is released so that the appropriate side clamp can pivot in its opening position around its link pin 9 and 10, respectively, due to the pressure of the ski boot sole. After the ski boot sole is released, the automatic reset of the link quadrangle occurs under the influence of the coil pressure spring 30. At the same time, reset of the side clamps 7, 8 is carried out by means of the connecting levers, inasmuch as the centering spring 70 pivots the connecting lever 53 arranged in the middle, into its starting position; connecting lever 53 serves as a locking member. For all shown embodiments, a movement of the side clamps 7, 8 with respect to the coupling element of the link quadrangle is avoided in the resilient area of the front piece. Consequently, also the friction which is created for such a movement is avoided. This means that the invention provides for an improvement of the reset characteristic of the front piece in comparison with known front pieces. The connecting levers which are disclosed as examples for the embodiments and which are provided between the arms 16 and 17 of thee side clamps 7 and 8—which arms 16 and 17 are provided in accordance with the invention—make it possible — due to the bent lever effect—that only small holding forces or control forces are required and that the inner friction of the components of the front piece is kept extremely low.

The present invention in its preferred forms thus relates to a front piece for safety ski-bindings which comprises a supporting member which can be pivoted sideways. The supporting member carries two side clamps which support the ski boot sole from the side and towards the front. Said supporting member is pivoted sideways if forces considered too high are applied from the side against the spring force of a detent means. The supporting member forms the coupling element of a link quadrangle. The levers of said link quadrangle are pivotally mounted on vertical axes which are secured to the base plate of the binding. Under normal conditions, the side clamps are maintained immovable with respect to the supporting member. However, after a predetermined amount of a pivotal movement of the supporting member has occurred, the side clamp which is located in front as far as the direction of movement is concerned will be pivoted outwardly so as to release the ski boot sole. After the ski boot sole has been released, an automatic reset operation of all movable components into the starting position of said components occurs. So as to keep the internal friction of the front piece extremely small, which in turn improves the re-set characteristic of the front piece, it is provided that the side clamps are extended beyond their respective points where they are linked to the supporting member. The side clamps releasably support each other by means of said extensions and for securing said support of each other at the supporting member, a locking member is provided which will release the side clamps at the end of the pivotal movement of the supporting member.

The invention has been described in detail with particular emphasis on its preferred embodiments, but it should be understood that variations and modifications within the spirit and scope of the invention may occur to those skilled in the art to which the invention pertains.

We claim:

1. A front piece for a safety ski binding, said front piece comprising:

base means mountable between the sides of a ski;

supporting means mounted for sideways movement on said base means, said supporting means including:

side clamp means for engaging the sides of a ski boot, said side clamp means having a holding condition for holding a ski boot in the front piece and an open condition for releasing a ski boot;

coupling means interconnecting said side clamp means;

mounting means for pivotally attaching said side clamp means to said coupling means; and, extension means attached to said mounting means beyond the point of pivotal attachment of said side clamp means to said coupling means for extending the effective length of said side clamp means;

releasing means connected to said extension means for controlling the condition of said side clamp means, said releasing means having a locking condition for restraining said extension means to lock said clamp means in the holding condition and an unlocking condition for enabling said clamp to assume the open condition; and, locking means for releasably locking said releasing means in the locking condition, said locking means moving to a releasing position in response to the pivoting of said support means beyond a predetermined amount in response to forces applied to said clamp means to unlock said releasing means to the unlocking condition to release said extension means and enable said clamp means to assume the open condition.

2. The invention according to claim 1 wherein said locking means comprises locking lever means pivotally mounted on said supporting means, and wherein the invention further includes control means mounted on said base means for pivoting said locking lever means to engage said releasing means to the releasing position in response to movement of said support means by said predetermined amount.

3. The invention according to claim 2 wherein said control means comprises a control member mounted in the central portion of said front piece, and said locking lever means comprises a pair of diverging curved arms located respectively on opposite sides of said control means for engaging said control means according to the one of said side clamp means to which force is applied.

4. The invention according to claim 3 wherein said control means comprises a spring biased bolt.

5. The invention according to claim 1, said supporting means further comprising connecting lever means for connecting said extension means together.

6. The invention according to claim 5 wherein said connecting lever means comprise connecting levers attached to the respective extension means, and said front piece further comprising connecting pin means for pivotally interconnecting said connecting levers, said releasing means including detent means wherein said locking means acts in cooperation with said detent means to restrain said connecting pin means in said detent means to releasably lock said clamp means in the holding condition.

7. The invention according to claim 1 wherein said releasing means includes detent means with movable detent indentation means for cooperating with said locking means, said movable detent indentation means comprising a pair of levers crossing each other, said crossing levers being mounted on axles attached to said base means, and spring means biasing said crossing levers at their intersection.

8. A front piece for a safety ski binding, said front piece comprising:

base means mountable between the sides of a ski;

supporting means mounted for sideways movement on said base means, said supporting means including:

side clamp means for engaging the sides of a ski boot, said side clamp means having a holding condition for holding a ski boot in the front piece and an open condition for releasing a ski boot;

coupling means interconnecting said side clamp means;

mounting means for pivotally attaching said side clamp means to said coupling means; and, extension means attached to said mounting means beyond the point of pivotal attachment of said side clamp means to said coupling means for extending the effective length of said side clamp means;

releasing means connected to said extension means for controlling the condition of said side clamp means, said releasing means having a locking condition for restraining said extension means to lock said clamp means in the holding condition and an unlocking condition for enabling said clamp to assume the open condition; and, locking means for releasably locking said releasing means in the locking condition, said locking means moving to a releasing position in response to the pivoting of said support means beyond a predetermined amount in response to forces applied to said clamp means to unlock said releasing means to the unlocking condition to release said extension means and enable said clamp means to assume the open condition; and, connecting lever means comprising connecting levers attached to the respective extension means, and said front piece further comprising connecting pin means for pivotally interconnecting said connecting levers, said releasing means including detent means wherein said locking means acts in cooperation with said detent means to restrain said connecting pin means in said detent means to releasably lock said clamp means in the holding condition.

* * * * *